US009925777B2

(12) United States Patent
Tokunaga

(10) Patent No.: US 9,925,777 B2
(45) Date of Patent: Mar. 27, 2018

(54) LIQUID RECEIVING DEVICE AND LIQUID EJECTING APPARATUS

(71) Applicant: SEIKO EPSON CORPORATION, Tokyo (JP)

(72) Inventor: Masayuki Tokunaga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 14/613,633

(22) Filed: Feb. 4, 2015

(65) Prior Publication Data

US 2015/0246540 A1 Sep. 3, 2015

(30) Foreign Application Priority Data

Feb. 28, 2014 (JP) ..... 2014-038186

(51) Int. Cl.
*B41J 2/165* (2006.01)

(52) U.S. Cl.
CPC ..... *B41J 2/16511* (2013.01); *B41J 2/16508* (2013.01)

(58) Field of Classification Search
CPC ..... B41J 2/16505
See application file for complete search history.

(56) References Cited

U.S. PATENT DOCUMENTS

2004/0061736 A1* 4/2004 Yun ..... B41J 2/16535 347/33
2007/0097170 A1* 5/2007 Sekiya et al. ..... 347/30
2009/0201336 A1* 8/2009 Yamamoto ..... B41J 2/16523 347/36
2009/0257803 A1* 10/2009 Okuda et al. ..... 400/59

FOREIGN PATENT DOCUMENTS

JP 09123469 A * 5/1997 ..... B41J 2/165
JP 2004268537 A 9/2004
JP 2008307770 A 12/2008
JP 2011-016314 1/2011
JP 2012-143921 8/2012
JP 2013-086328 5/2013

* cited by examiner

*Primary Examiner* — Kristal Feggins
*Assistant Examiner* — Kendrick Liu
(74) *Attorney, Agent, or Firm* — Workman Nydegger

(57) ABSTRACT

A liquid receiving device including a liquid holding unit that has a bottom unit and a peripheral wall unit that is installed in the bottom unit in a protruding manner, and in which the bottom unit and the peripheral wall unit form a liquid accumulation unit that is capable of accumulating a liquid. The liquid holding unit is capable of moving in a movement direction that intersects a direction of gravity, and has protruding units that protrude further upward than the bottom unit in a vertical direction in the liquid accumulation unit.

16 Claims, 6 Drawing Sheets

LIQUID RECEIVING DEVICE AND LIQUID EJECTING APPARATUS

CROSS-REFERENCE TO RELATED APPLICATIONS

The entire disclosure of Japanese Patent Application No. 2014-038186, filed Feb. 28, 2014, is expressly incorporated by reference.

BACKGROUND

1. Technical Field

The present invention relates to a liquid receiving device that is capable of receiving a liquid such as ink and a liquid ejecting apparatus.

2. Related Art

An ink jet type printer that performs printing by discharging ink from nozzles provided in a recording head is an example of a liquid ejecting apparatus. Among printers that are configured in this manner, there are printers that are provided with a cap member that is capable of receiving ink that is discharged from the nozzles, and move the cap member while retaining a horizontal attitude of the cap member (for example, JP-A-2011-16314).

Given that, if a cap member in which liquid is held is moved in a movement direction that intersects the direction of gravity, liquid that is held in the cap member tends to flow toward a direction that is opposite to the movement direction due to an inertial force. In addition, if a cap member that is being moved is rapidly stopped, liquid that is held in the cap member tends to flow toward a movement direction due to an inertial force. Further, there is a technical problem in that, if liquid that flows due to an inertial force in this manner runs into a peripheral wall of the cap member, the liquid overflows from the cap member and scatters in the vicinity, and therefore, the inside of the apparatus becomes dirty.

Additionally, this kind of technical goal is not limited to a cap member that receives ink, and is generally common to liquid receiving devices and liquid ejecting apparatuses that are provided with liquid holding units such as flushing boxes, which receive liquid that is discharged from nozzles in flushing, that move in a state of holding a liquid.

SUMMARY

An advantage of some aspects of the invention is to provide a liquid receiving device that is capable of suppressing the scattering of liquid that flows due to inertial force when a liquid holding unit, which is holding a liquid, moves or stops and a liquid ejecting apparatus.

Hereinafter, means for solving the abovementioned technical problem and the functional effects thereof will be described.

According to an aspect of the invention, there is provided a liquid receiving device including a liquid holding unit that has a bottom unit and a peripheral wall unit that is installed in the bottom unit in a protruding manner, and in which the bottom unit and the peripheral wall unit form a liquid accumulation unit that is capable of accumulating a liquid. The liquid holding unit is capable of moving in a movement direction that intersects a direction of gravity, and has protruding units that protrude further upward than the bottom unit in a vertical direction in the liquid accumulation unit.

In this case, as a result of the liquid, which tends to flow inside the liquid accumulation unit due to an inertial force when the liquid holding unit moves or stops, colliding against the protruding units, a carrying speed of the liquid along the movement direction becomes slower, and therefore, an amount of the liquid that reaches the peripheral wall unit is lessened. Therefore, even if the liquid that flows due to an inertial force collides with the peripheral wall unit, it is difficult for the liquid to pass over the peripheral wall unit and pour out therefrom. Therefore, it is possible to suppress scattering of the liquid that flows due to an inertial force when the liquid holding unit, which is holding the liquid, moves, or when the liquid holding unit stops.

In the liquid receiving device, it is preferable that, in addition to a discharge hole for discharging the liquid that is accumulated in the liquid accumulation unit being provided in the bottom unit, the peripheral wall unit be provided in the bottom unit in a protruding manner so as to surround the discharge hole, and pathway units that allow the flow of liquid along the movement direction be provided in the liquid accumulation unit in positions that are lined up with the protruding units in an extension direction of the bottom unit that intersects the direction of gravity and the movement direction.

In this case, since the pathway units are provided in the liquid accumulation unit in positions that are lined up with the protruding units in an extension direction of the bottom unit, the liquid that is carried along the bottom unit can flow along the movement direction through the pathway units. Therefore, it is possible for the liquid that is accumulated in the liquid accumulation unit to flow through the pathway units and flow into the discharge hole.

In the liquid receiving device, it is preferable that, in addition to the pathway units being provided in the liquid accumulation unit in positions that are lined up with the protruding units in the movement direction, the protruding units be provided in positions that are lined up with the pathway units in the movement direction.

In this case, the liquid that flows in a direction along the movement direction through the pathway units collides with the protruding units that are disposed in positions that are lined up with the pathway units in the movement direction. In addition, after flowing along the protruding units in a direction that intersects the movement direction and passing through the pathway units, the liquid that collides with the protruding units is carried toward the pathway units, which are in positions that are lined up with the protruding units in the movement direction. As a result of this configuration, since it is possible to cause the liquid to flow along the movement direction in a manner in which the liquid meanders due to the repetition of divergence and convergence, a flow velocity of the liquid along the movement direction is reduced, a carrying speed of the liquid that runs into the peripheral wall unit is slowed down, and therefore, it is possible to reduce an amount of the liquid that runs into the peripheral wall unit.

In the liquid receiving device, it is preferable that, in the liquid accumulation unit, a first row in which even-numbered protruding units and odd-numbered pathway units are mutually lined up in the extension direction, and a second row in which odd-numbered protruding units and even-numbered pathway units are mutually lined up in the extension direction, be provided so as to be mutually lined up in the movement direction.

In this case, since the protruding units and the pathway units are disposed along the extension direction and the movement direction in a regular manner, it is possible to reduce the carrying speed of the liquid and deviations in the amount of the liquid that flows inside the liquid accumulation unit.

In the liquid receiving device, it is preferable that the protruding units and the pathway units be disposed so as to be in line symmetry in the extension direction of the liquid accumulation unit with a center line thereof as a target axis thereof.

In this case, since the protruding units and the pathway units are disposed in a regular manner in the extension direction, it is possible to reduce the carrying speed of the liquid and deviations in the amount of the liquid that flows inside the liquid accumulation unit.

In the liquid receiving device, it is preferable that the protruding units be provided in the bottom unit in a protruding manner, and, in protruding heights from the bottom unit, that of the peripheral wall unit be greater than that of the protruding units.

In this case, due to the peripheral wall unit that is higher than the protruding units, it is even possible to suppress a circumstance in which the liquid passes over the outside of the liquid accumulation unit in a case in which the liquid that flows inside the liquid accumulation unit and collides with the protruding units flows over the protruding units.

In the liquid receiving device, it is preferable that the movement direction effectively be a horizontal direction.

In this case, when the liquid holding unit effectively moves in a horizontal direction, or stops such movement, as a result of the protruding units that protrude upward in a vertical direction, it is possible to reduce a momentum of the liquid that tends to flow in the horizontal direction due to an inertial force.

In the liquid receiving device, it is preferable that the movement direction be a direction that intersects the direction of gravity and the horizontal direction, and the protruding units be disposed in positions which are separated from the peripheral wall unit in the movement direction.

If the liquid holding unit moves in a direction that intersects a horizontal direction, since a component that acts in a vertical direction is included in the inertial force that causes the liquid to flow, there is a concern that the liquid that collides with the protruding units will flow over the protruding units. With respect to this matter, in this case, since the protruding units are disposed in positions which are separated from the peripheral wall unit in the movement direction, due to the peripheral wall unit which is in front of the protruding units, it is even possible to suppress the liquid from flowing in a case in which the liquid that collides with the protruding units flows over the protruding units.

In the liquid receiving device, it is preferable that the liquid holding unit be capable of moving between a receiving position, at which the liquid holding unit is capable of receiving liquid, and a standby position that is set below the receiving position in a vertical direction, and a movement route of the liquid holding unit include a portion that effectively extends from the standby position in a horizontal direction in a horizontal direction, and a portion that effectively extends from the receiving position in a direction of gravity.

In this case, since the movement route of the liquid holding unit includes a portion that effectively extends from the receiving position in a direction of gravity, at which it is possible to receive the liquid, it is difficult for the liquid to flow in a horizontal direction when movement of the liquid holding unit from the standby position is initiated and stopped at the receiving position. Therefore, it is possible to suppress scattering of the liquid when the movement of the liquid holding unit is stopped at the receiving position.

In the liquid receiving device, it is preferable that the liquid holding unit have a liquid receiving unit that is disposed in the liquid accumulation unit above the protruding units in a vertical direction, and, a relationship of Vb>Va>Vw be attained when an area of a bottom surface of the liquid accumulation unit that the bottom unit forms is set as Vb, an area that the protruding units project onto the bottom surface is set as Vw, and an area that the liquid receiving unit projects onto the bottom surface is set as Va.

In this case, since the liquid receiving unit, the projection area on the bottom surface of which is greater than that of the protruding units, is disposed in the liquid accumulation unit above the protruding units in a vertical direction, due to the liquid receiving unit, it is possible to suppress carrying of the liquid that tends to flow over the protruding units. In addition, since a projection area of the liquid receiving unit on the bottom surface is smaller than the area of the bottom surface, it is possible for the liquid that the liquid receiving unit received to flow into the liquid accumulation unit.

It is preferable that the liquid receiving device further include an attitude retention mechanism that causes an attitude of the liquid holding unit to be retained so that the bottom unit becomes horizontal during movement in the movement direction and stopping.

In this case, since, due to the attitude retention mechanism, the attitude of the liquid holding unit is retained so that the bottom unit becomes horizontal, it is even difficult for the liquid to spill outside the liquid accumulation unit in a case in which the liquid that is accumulated in the liquid accumulation unit flows due to an inertial force during movement in the movement direction and stopping.

According to another aspect of the invention, there is provided a liquid ejecting apparatus including a liquid ejecting unit that is capable of ejecting a liquid, and the abovementioned liquid receiving device.

In this case, it is possible to obtain the same functional effects as the abovementioned liquid receiving device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to the drawings. The liquid ejecting apparatus is, for example, an ink jet type printer that performs recording (printing) by ejecting ink, which is an example of a liquid onto a medium such as sheets of paper.

Figure 1:
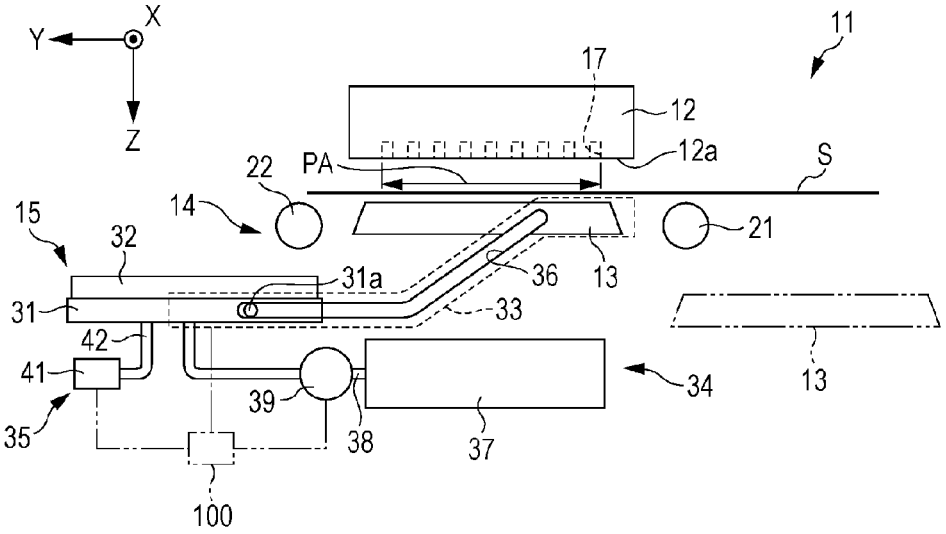
FIG. 1 is a side view that shows a configuration of a liquid ejecting apparatus of an embodiment.

As shown in FIG. 1, a liquid ejecting apparatus 11 is provided with a liquid ejecting unit 12 that is capable of ejecting a liquid, a supporting platform 13 for supporting media S, a transport mechanism 14 for transporting the media S in a transport direction Y, and a liquid receiving device 15 that receives liquid that is discharged from the liquid ejecting unit 12. The transport mechanism 14 is provided with transport rollers 21 and 22, which, for example, are disposed on an upstream side and a downstream side of a printing region PA in the transport direction Y. Additionally, the transport mechanism 14 may be configured so as to be provided with a transport belt onto which it is possible to mount the medium S.

A plurality of nozzles 17 that eject the liquid as liquid droplets are provided in the liquid ejecting unit 12. The liquid ejecting unit 12 performs printing by ejecting liquid droplets from the nozzles 17 onto the media S that is transported by the transport mechanism 14 in the printing region PA.

The supporting platform 13 moves between a supporting position that is set in the printing region PA (a position that is shown by a solid line in FIG. 1) and a refuge position that is separated from the printing region PA (a position that is shown by a two-dot chain line in FIG. 1). For example, the supporting platform 13 moves to the supporting position when a medium S is transported to the printing region PA, and supports a medium S that receives liquid droplets. In addition, when printing has finished or the like, the supporting platform 13 moves to the refuge position.

The liquid receiving device 15 is provided with a liquid holding unit 32 that is supported by a supporting member 31, a movement mechanism 33 that, through the supporting member 31, moves the liquid holding unit 32 along a movement direction that intersects a direction of gravity Z, a discharge mechanism 34 that is connected to the liquid holding unit 32 and an air opening mechanism 35 that is connected to the liquid holding unit 32. In addition, the liquid ejecting apparatus 11 is provided with a control unit 100 that performs control of the movement mechanism 33, the discharge mechanism 34 and the air opening mechanism 35.

Figure 2:
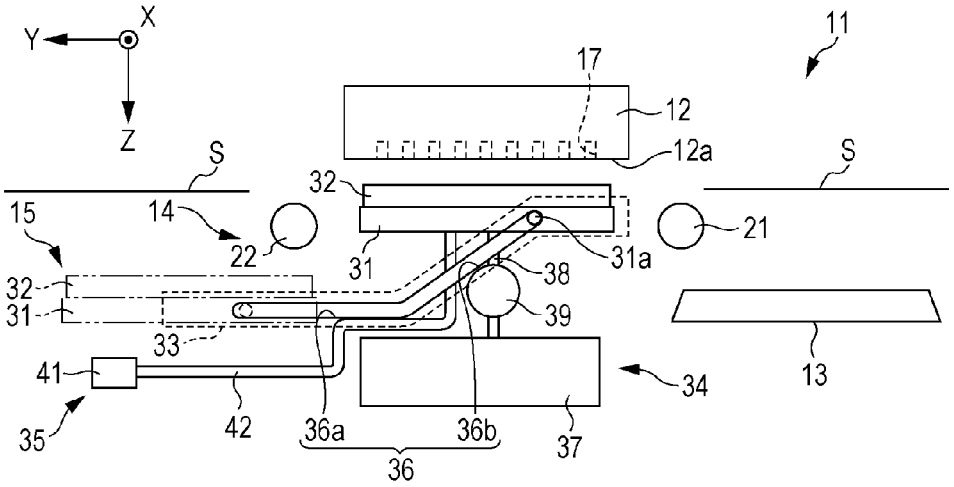
FIG. 2 is a side view that shows an action of a liquid receiving device of an embodiment.

As shown in FIG. 2, the movement mechanism 33 has a guide rail 36 that guides a salient unit 31*a* that is provided on the supporting member 31, and moves the liquid holding unit 32 between a receiving position that is set in the printing region PA (a position that is shown by a solid line in FIG. 2) and a standby position that is separated from the printing region PA (a position that is shown by a two-dot chain line in FIG. 2). The standby position of the liquid holding unit 32 is, for example, below the receiving position in a vertical direction, and is set to a position that is separated from the receiving position in the transport direction Y.

The guide rail 36 includes a horizontal unit 36*a* that effectively extends from the standby position in a horizontal direction, and an inclined unit 36*b* that extends in an oblique manner from the receiving position in a direction that intersects the horizontal. Further, when the liquid holding unit 32 moves between the receiving position and the standby position, the salient unit 31*a* of the supporting member 31 is guided by the guide rail 36.

For example, when the liquid holding unit 32 moves toward the receiving position from the standby position, firstly, the liquid holding unit 32 moves in a horizontal direction along the horizontal unit 36*a*, and subsequently moves along the inclined unit 36*b* in a direction that intersects the direction of gravity Z and the horizontal direction. Additionally, in the guide rail 36, it is preferable to configuration so as to suppress catching of the liquid holding unit 32 at a connecting portion of the horizontal unit 36*a* and the inclined unit 36*b* by causing the connecting portion of the horizontal unit 36*a* and the inclined unit 36*b* to be curved.

The discharge mechanism 34 is provided with a recovery body 37 that is capable of admitting the liquid thereinto, a discharge flow channel 38 that connects the recovery body 37 and the liquid holding unit 32, and a decompression unit 39 that is disposed at an intermediate position of the discharge flow channel 38. The air opening mechanism 35 is provided with an air opening valve 41, and a ventilation flow path 42 that connects the air opening valve 41 and the liquid holding unit 32. The discharge flow channel 38 and the ventilation flow path 42 are, for example, formed from a flexible tube, and are displaced along with the movement of the liquid holding unit 32.

Figure 3:
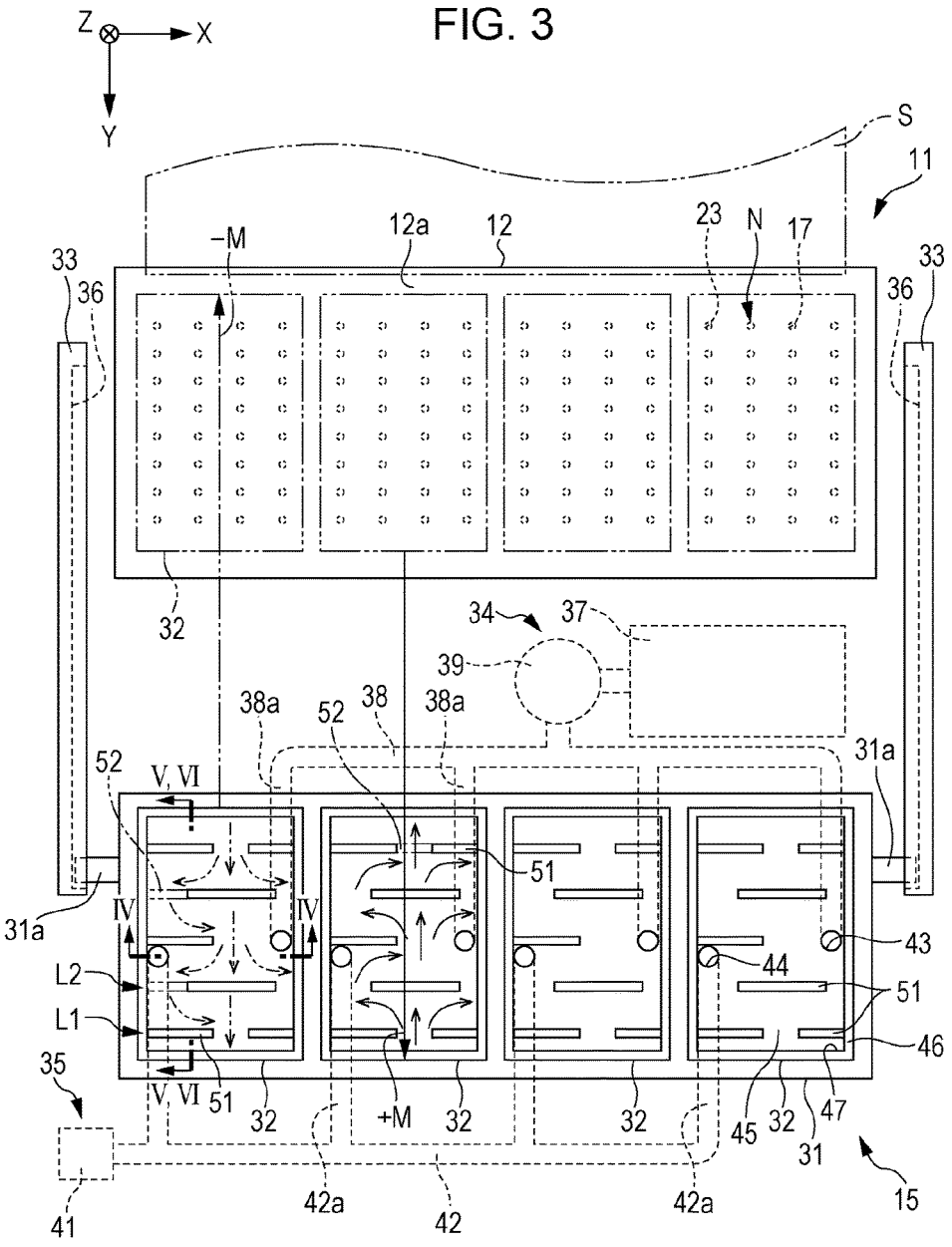
FIG. 3 is a top view that shows configurations of a liquid ejecting unit and a liquid receiving device.

As shown in FIG. 3, in the liquid ejecting unit 12 of the present embodiment, a width direction X of the media S, which intersects the transport direction Y, becomes a longitudinal direction. Liquid droplet ejection apertures 23, which become a downstream end of the nozzles 17 are opened in an opening surface 12*a* that is provided in the liquid ejecting unit 12.

In addition to the plurality of nozzles 17 forming nozzle rows N by being lined up in directions which intersects the transport direction Y and the width direction X, a plurality of nozzle rows N are disposed in the liquid ejecting unit 12 spaced apart in the width direction X by a predetermined gap. Additionally, the number of the nozzles 17 and the number of the nozzle rows N that are provided in the liquid ejecting unit 12 can be changed arbitrarily.

The salient unit 31*a* of the supporting member 31 engages with a pair of guide rails 36 that are provided in a protruding manner so as to form a pair in positions, which are both end sides in the width direction X and form the upstream side in the transport direction Y, and are disposed at both end sides in the width direction X of the supporting member 31.

In the present embodiment, a movement direction of the liquid holding unit 32 from the receiving position that is shown by a two-dot chain line in FIG. 3 toward the standby position that is shown by a solid line in FIG. 3 is set as a first movement direction +M, and a movement direction of the liquid holding unit 32 from the standby position toward the receiving position is set as a second movement direction −M. That is, in the first movement direction +M, in addition to the receiving position becoming an initial position of movement, the standby position becomes a terminal position of movement. In addition, in the in the second movement direction −M, in addition to the standby position becoming an initial position of movement, the receiving position becomes a terminal position of movement. Additionally, in the present embodiment, in cases that do not discriminate between the first movement direction +M and the second movement direction −M, there are cases in which the term movement direction M is used.

A plurality (four in the present embodiment) of liquid holding units 32 are disposed in the supporting member 31 so as to be lined up in the width direction X corresponding to the liquid ejecting unit 12. The liquid holding units 32 of the present embodiment include a discharge hole 43 which is in communication with the discharge flow channel 38, a communication hole 44 that is in communication with the ventilation flow path 42, a bottom unit 45 in which the discharge hole 43 and the communication hole 44 are provided, and a peripheral wall unit 46 that is provided in the bottom unit 45 in a protruding manner so as to surround the discharge hole 43 and the communication hole 44.

The liquid holding unit 32 is a box-shaped cap with a bottom in which the bottom unit 45 and the peripheral wall unit 46 form a liquid accumulation unit 47 that is capable of accumulating the liquid, and an open part of the cap that the peripheral wall unit 46 forms is a size that is capable of surrounding the ejection apertures 23 of a plurality of nozzle rows N (for example, four rows). Additionally, the number of liquid holding units 32 that the liquid receiving device 15 is provided with can be changed arbitrarily. For example, in a case in which all of the ejection apertures 23 are surrounded by a single liquid holding unit 32, the liquid receiving device 15 may be provided with a single liquid holding unit 32.

In cases in which there is a plurality of liquid holding units 32, in addition to end sides of the discharge flow channel 38 and the ventilation flow path 42 that are connected to the bottom unit 45 of the liquid holding unit 32 being branched into a plurality thereof and respectively becoming the branched flow channels 38*a* and 42*a*, the other end sides of the discharge flow channel 38 and the ventilation flow path 42 at which a plurality of branched flow channels 38*a* and 42*a* converge are respectively connected to the recovery body 37 and the air opening valve 41.

The liquid holding unit 32 includes a plurality of protruding units 51 that protrude further upward in a vertical direction than the bottom unit 45 in the liquid accumulation unit 47. In addition, pathway units 52 that allow the flow of the liquid along the movement direction M are provided in the liquid accumulation unit 47 in positions that are lined up with the protruding units 51 in an extension direction (the width direction X in the present embodiment) of the bottom unit 45 that intersects the direction of gravity Z and the movement direction M. Additionally, it is preferable that the protruding units 51 be disposed in positions that are separated from the peripheral wall unit 46 in the movement direction M. For example, in FIG. 3, within the peripheral wall unit 46, the protruding units 51 are disposed in positions that are separated from portions that extend in the width direction X, which is orthogonal to the movement direction M.

In the liquid accumulation unit 47, it is preferable that a first row L1 in which even-numbered protruding units 51 and odd-numbered pathway units 52 are mutually lined up in the extension direction (the width direction X), and a second row L2 in which odd-numbered protruding units 51 and even-numbered pathway units 52 are mutually lined up in the extension direction (the width direction X), be provided so as to be mutually lined up spaced apart in the movement direction M by a predetermined gap.

In addition, in the liquid accumulation unit 47, it is preferable that the first row L1 and the second row L2 be disposed so that while the pathway units 52 are disposed in positions that line up with the protruding units 51 in the movement direction M, the protruding units 51 are disposed in positions that line up with the pathway units 52 in the movement direction M.

However, it is preferable that the protruding units 51 be disposed in positions that do not overlap with the discharge hole 43 and the communication hole 44 in the vertical direction. For example, in cases which protruding units 51 that configure the first row L1 and the second row L2 overlap with the discharge hole 43 or the communication hole 44 when disposing the first row L1 and the second row L2, it is preferable that the protruding units 51 which are in those positions be omitted.

Figure 4:
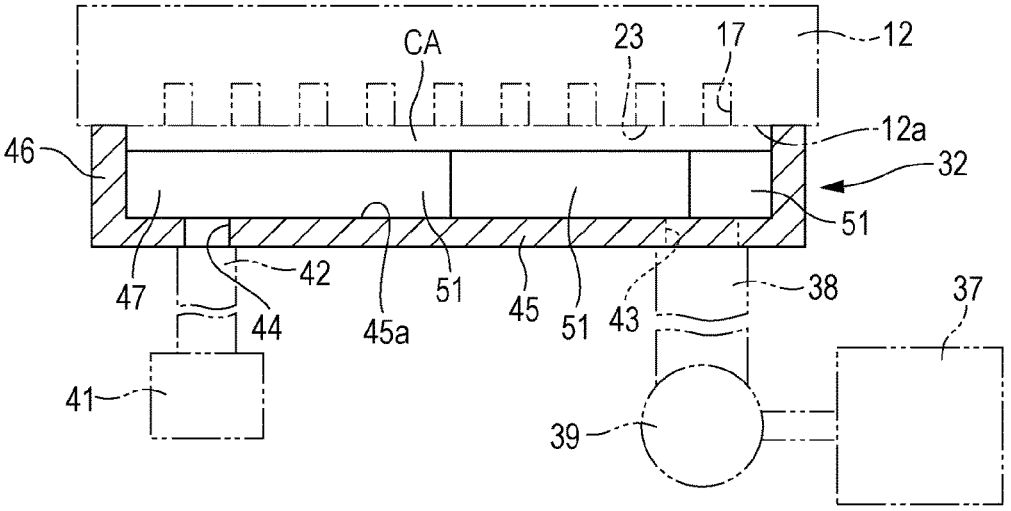
FIG. 4 is a cross-sectional view along the arrows of the lines IV-IV in FIG. 3.

As shown in FIG. 4, the bottom unit 45 of the liquid holding unit 32 has a bottom surface 45*a* that forms the liquid accumulation unit 47. Furthermore, in addition to the protruding units 51 being provided in the bottom unit 45 in a protruding manner, in protruding heights from the bottom unit 45 (the bottom surface 45*a*), that of the peripheral wall unit 46 is greater than that of the protruding units 51.

Next, an action of the liquid receiving device 15 will be described.

When the liquid ejecting unit 12 finishes printing, in addition to setting the air opening valve 41 to a closed valve state, the control unit 100 controls the movement mechanism 33 thereby causing the liquid holding unit 32, which is in the standby position, to be disposed in the receiving position by moving the liquid holding unit 32 in the second movement direction −M.

Further, as shown in FIG. 4, capping, which sets the liquid accumulation unit 47 to a closed space CA is performed by the liquid holding unit 32 moving relatively with respect to the liquid ejecting unit 12, and coming into contact with the opening surface 12*a* of the liquid ejecting unit 12 so that a leading end portion of the peripheral wall unit 46 surrounds the ejection apertures 23. Additionally, capping can be performed by moving the liquid ejecting unit 12 with respect to the liquid holding unit 32 that is in the receiving position, or may be performed by moving the liquid holding unit 32 that is in the receiving position with respect to the liquid ejecting unit 12. Since, as a result of capping, it becomes difficult for the nozzles 17 to dry out, the occurrence of ejection defects that result from clogging up of the nozzles 17 is suppressed.

When printing is initiated after the execution of capping, capping is released by the liquid holding unit 32 moving relatively in a direction that becomes separated from the liquid ejecting unit 12. Additionally, a target with which the liquid holding unit 32 comes into contact during the capped state is not limited to the opening surface 12*a*, and for example, it is also possible to form a closed space CA in which the ejection apertures 23 are open by causing a side surface portion of the liquid ejecting unit 12, or a holding body that holds the liquid ejecting unit 12 to come into contact with the liquid holding unit 32.

In addition, in a case in which a liquid droplet ejection defect occurs in the nozzles 17 or the like, as a maintenance action for resolving the ejection defect, in addition to setting the air opening valve 41 to a closed valve state, the control unit 100 drives the decompression unit 39 in a state in which the liquid holding unit 32 has performed capping of the liquid ejecting unit 12. As a result of this, since the closed space CA in which the ejection apertures 23 are open is depressurized and attains a negative pressure through the discharge hole 43, suction cleaning in which, in addition to liquid from the nozzles 17, foreign bodies such as air bubbles and the like that are the cause of ejection defects are discharged, is performed. Furthermore, in addition to being temporarily accumulated in the liquid accumulation unit 47 of the liquid holding unit 32, the liquid that is discharged from the nozzles 17 is discharged from the liquid accumulation unit 47 via the discharge hole 43 with driving of the decompression unit 39. Further, the discharged liquid is recovered by the recovery body 37 via the discharge flow channel 38.

Additionally, after the suction cleaning has been performed, as a result of the control unit 100 setting the air opening valve 41 to an open valve state, the negative pressure of the closed space CA is reduced, and capping is released. In addition, air suctioning that discharges the liquid that is accumulated in the liquid accumulation unit 47 via the discharge hole 43 is performed as a result of the control unit 100 driving the decompression unit 39. As long as the air opening valve 41 is set to an open valve state, this kind of air suctioning may also be performed in a state in which capping has been set.

In this manner, the air opening valve 41 causes the closed space CA to be in communication with the air through the communication hole 44 as a result of attaining an open valve state. Additionally, the decompression unit 39 can, for example, be set as a tube pump that has a rotational member, which rotates while squashing a tube as the discharge flow channel 38. In a case in which this configuration is adopted, it is possible to open the closed space CA to air by releasing the squashing of the tube by the rotational member. In addition, in a case in which an air opening valve is provided in the discharge flow channel 38, it is possible to open the closed space CA to air by opening the air opening valve. In this manner, in a case in which it is possible to cause the discharge mechanism 34 to function as an air opening mechanism, the air opening mechanism 35 need not be provided.

Furthermore, in the liquid ejecting apparatus 11, there are also instances in which flushing, in which the liquid ejecting unit 12 ejects liquid droplets toward the liquid holding unit 32 which is in the receiving position, is performed as a maintenance action for resolving ejection defects. Further, after flushing has been performed, air suctioning that discharges the liquid that is accumulated in the liquid accumulation unit 47 via the discharge hole 43 is performed by driving the decompression unit 39.

Next, the effects of the liquid ejecting apparatus 11 which is configured in the abovementioned manner will be described.

In a case in which the liquid ejecting apparatus 11 of the present embodiment performs printing continuously on multiple media S, flushing is performed each time printing of a predetermined number of sheets has been completed, or each time a predetermined amount of time elapses. At this time, since a time taken until printing finished becomes longer if transport of the media S is stopped for flushing, it is preferable that flushing be performed in an interval (a paper gap) of a medium S upon which printing has been completed being transported from the printing region PA and a subsequent medium S being transported to the printing region PA.

In this case, it is necessary perform a series of actions of moving the liquid holding unit 32 in an outward manner from the standby position to the receiving position in addition to moving the supporting platform 13 in an outward manner from the supporting position to the refuge position, performing flushing, and moving the supporting platform 13 in a return manner from the refuge position to the supporting position in addition to moving the liquid holding unit 32 in a return manner from the receiving position to the standby position in the interval of transport of the media S.

In addition, after flushing has been performed a first time in an interval of printing due to a series of actions such as this, flushing is performed a second time by moving the supporting platform 13 and the liquid holding unit 32 again when printing of a predetermined number of sheets or a predetermined amount of time has been performed. Hereupon, in a case in which a transport speed of the media S is particularly fast, there are instances in which the liquid holding unit 32 receives the liquid that is ejected by flushing, and a period in which the liquid holding unit 32 is stopped in the standby position is an insufficient amount of time to perform air suctioning for discharging the liquid, and therefore, the discharge of the liquid is also performed when the liquid holding unit 32 is moving.

Alternatively, in a case in which an amount of the liquid that is discharged by a first flushing is small, there are cases in which there is not an amount of the liquid to perform suctioning during flushing remaining in the liquid accumulation unit 47. In this case, suctioning of the liquid accumulation unit 47 is performed by performing flushing multiple times and driving the decompression unit 39 at a stage at which there is an amount of liquid which is in the liquid accumulation unit 47 remaining.

In this kind of case, the liquid holding unit 32 moves in the first movement direction −M from the receiving position and stops at the standby position, and moves in the second movement direction −M from the standby position and stops at the receiving position in a state in which the liquid that has been received at the receiving position is accumulated in the liquid accumulation unit 47.

Figure 5:
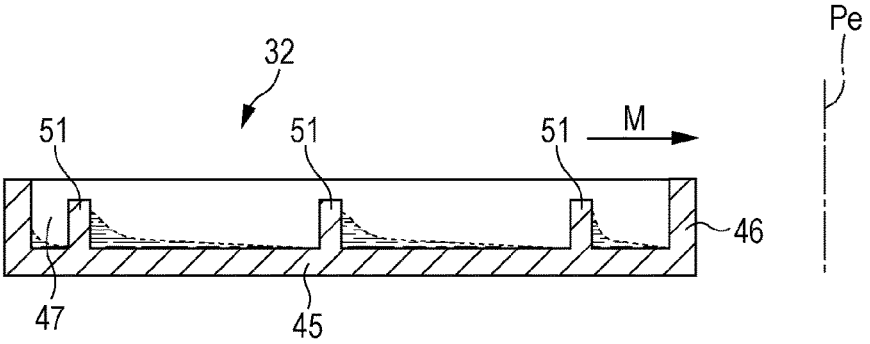
FIG. 5 is a cross-sectional view in which a surface that shows a liquid holding unit during movement has been cut out at the arrows of the lines V-V in FIG. 3.

In this instance, as shown in FIG. 5, if the liquid holding unit 32 moves in the movement direction M, the liquid that is accumulated in the liquid accumulation unit 47 (shown by a dotted line in FIG. 5) flows in a direction that is opposite to the movement direction M due to an inertial force, and collides with the protruding units 51 and the peripheral wall unit 46. Additionally, the liquid holding unit 32 of the present embodiment moves in a direction that intersects a horizontal direction and a direction of gravity when movement from the receiving position is initiated, but an inertial force that acts upon the liquid along with this movement includes a component that acts in a horizontal direction. Therefore, even when the liquid holding unit 32 has initiated movement from the receiving position, the liquid that is accumulated in the liquid accumulation unit 47 collides with the protruding units 51 and the peripheral wall unit 46 in the same manner as a case in which the liquid holding unit 32 moves in a horizontal direction.

Figure 6:
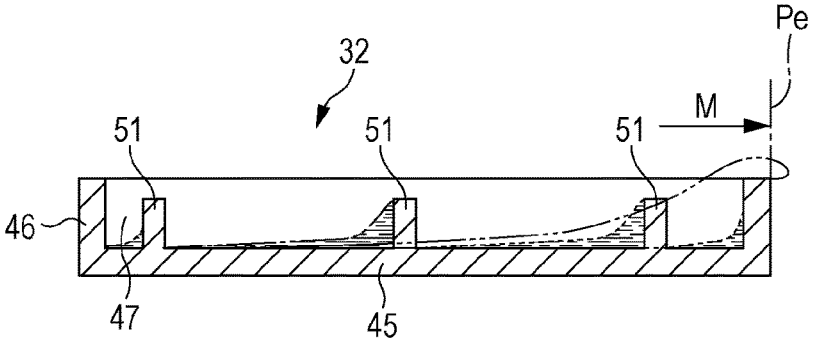
FIG. 6 is a cross-sectional view in which a surface that shows a liquid holding unit during stopping has been cut out at the arrows of the lines VI-VI in FIG. 3.

In addition, as shown in FIG. 6, if the liquid holding unit 32 stops at a terminal position Pe (the receiving position or the standby position) in the movement direction M, the liquid that is accumulated in the liquid accumulation unit 47 (shown by a dotted line in FIG. 6) flows in the movement direction M due to an inertial force, and collides with the protruding units 51 and the peripheral wall unit 46. Additionally, the liquid holding unit 32 of the present embodiment moves in a direction that intersects a horizontal direction and a direction of gravity immediately prior to stopping at the receiving position, but an inertial force that acts upon the liquid along with this movement includes a component that acts in a horizontal direction. Therefore, even when the liquid holding unit 32 stops at the receiving position, the liquid that is accumulated in the liquid accumulation unit 47 collides with the protruding units 51 and the peripheral wall unit 46 in the same manner as a case in which the liquid holding unit 32 moves in a horizontal direction.

At this time, if the protruding units 51 are not provided in the liquid holding unit 32, the liquid flows up to the peripheral wall unit 46 in one go due to an inertial force and collides with the peripheral wall unit 46 with a large amount of force, and therefore, there is a concern that the liquid will flow over the peripheral wall unit 46 as shown by the two-dot chain line in FIG. 6. With respect to this matter, in the present embodiment, since the liquid that flows due to an inertial force collides with the plurality of protruding units 51, a flow velocity of the liquid along the movement direction M is reduced, and an amount of liquid that reaches the peripheral wall unit 46 is lessened as a result. Therefore, even if a portion of the liquid reaches the peripheral wall unit 46 and collides with the peripheral wall unit 46, and since the amount thereof is small and carrying speed is thereof slow, it is difficult for the liquid to spill outside the liquid accumulation unit 47.

In particular, in a case in which the protruding units 51 and the pathway units 52 are disposed so as to be mutually lined up in the movement direction M as shown in FIG. 3, after the liquid that flows due to an inertial force collides with the protruding units 51, the liquid flows in the width direction X, passes through the pathway units 52, and attains a situation of being carried in the movement direction M while meandering due to the repetition of divergence and convergence as a result. Therefore, it is possible to successfully reduce a velocity with which the liquid flows in comparison with a case in which there are no protruding units 51, and the liquid flows directly along the movement direction M due to an inertial force.

In addition, since the liquid is allowed to flow along the movement direction M through the pathway units 52, in a case in which the decompression unit 39 is driven or the like, it is possible to discharge the liquid that has accumulated in the liquid accumulation unit 47 through the discharge hole 43.

According to the abovementioned embodiment, it is possible to obtain the following effects.

(1) As a result of the liquid, which tends to flow inside the liquid accumulation unit 47 due to an inertial force when the liquid holding unit 32 moves or stops, colliding against the protruding units 51, a carrying speed of the liquid along the movement direction M becomes slower, and therefore, an amount of the liquid that reaches the peripheral wall unit 46 is lessened. Therefore, even if the liquid that flows due to an inertial force collides with the peripheral wall unit 46, it is difficult for the liquid to pass over the peripheral wall unit 46 and pour out therefrom. Therefore, it is possible to suppress scattering of the liquid that flows due to an inertial force when the liquid holding unit 32, which is holding the liquid, moves, or when the liquid holding unit 32 stops.

(2) Since the pathway units 52 are provided in the liquid accumulation unit 47 in positions that are lined up with the protruding units 51 in the extension direction (the width direction X) of the bottom unit 45, the liquid that is carried along the bottom unit 45 can flow along the movement direction M through the pathway units 52. Therefore, it is possible for the liquid that is accumulated in the liquid accumulation unit 47 to flow through the pathway units 52 and flow into the discharge hole 43.

(3) The liquid that flows in a direction along the movement direction M through the pathway units 52 collides with the protruding units 51 that are disposed in positions that are lined up with the pathway units 52 in the movement direction M. In addition, after flowing along the protruding units 51 in a direction that intersects the movement direction M and passing through the pathway units 52, the liquid that collides with the protruding units 51 is carried toward the pathway units 52, which are in positions that are lined up with the protruding units 51 in the movement direction M. As a result of this configuration, since it is possible to cause the liquid to flow along the movement direction M in a manner in which the liquid meanders due to the repetition of divergence and convergence, a flow velocity of the liquid along the movement direction M is reduced, a carrying speed of the liquid that runs into the peripheral wall unit 46 is slowed down, and therefore, it is possible to reduce an amount of the liquid that runs into the peripheral wall unit 46.

(4) As a result of the protruding units 51 and the pathway units 52 being disposed in a regular manner along the extension direction (the width direction X) and the movement direction M, it is possible to reduce the carrying speed of the liquid and deviations in the amount of the liquid that flows inside the liquid accumulation unit 47.

(5) As a result of the peripheral wall unit 46 that is higher than the protruding units 51, it is even possible to suppress a circumstance in which the liquid passes over the outside of the liquid accumulation unit 47 in a case in which the liquid that flows inside the liquid accumulation unit 47 and collides with the protruding units 51 flows over the protruding units 51.

(6) When the liquid holding unit 32 effectively moves in a horizontal direction, or stops such movement, as a result of the protruding units 51 that protrude upward in a vertical direction, it is possible to reduce a momentum of the liquid that tends to flow in the horizontal direction due to an inertial force.

(7) If the liquid holding unit 32 moves in a direction that intersects a horizontal direction, since a component that acts in a vertical direction is included in the inertial force that causes the liquid to flow, there is a concern that the liquid that collides with the protruding units 51 will flow over the protruding units 51. With respect to this matter, according to the abovementioned configuration, since the protruding units 51 are disposed in positions which are separated from the peripheral wall unit 46 in the movement direction M, due to the peripheral wall unit 46 which is in front of the protruding units 51, it is even possible to suppress the liquid from flowing in a case in which the liquid that collides with the protruding units 51 flows over the protruding units 51.

Additionally, the abovementioned embodiment may be changed in the manners of the modification examples that are shown below. Additionally, in the following modification examples, since components that have the same reference numerals as the abovementioned embodiment are provided with the same configurations as the abovementioned embodiment, the descriptions thereof have been omitted, and the following description will be given focusing on features that differ from the abovementioned embodiment.

For example, as shown in FIGS. 7A to 9B, the shape, disposition and number of the protruding units 51 and the pathway units 52 can be changed arbitrarily depending on the shape of the liquid holding unit 32, the movement direction M or the like. Additionally, in FIGS. 7A to 9B, in order to specify the configurations of the protruding units 51 and the pathway units 52, the illustration of the discharge hole 43 and the communication hole 44 has been omitted, but the shape, disposition and number of the discharge hole 43 and the communication hole 44 in the bottom unit 45 can also be changed arbitrarily.

Figure 7A:
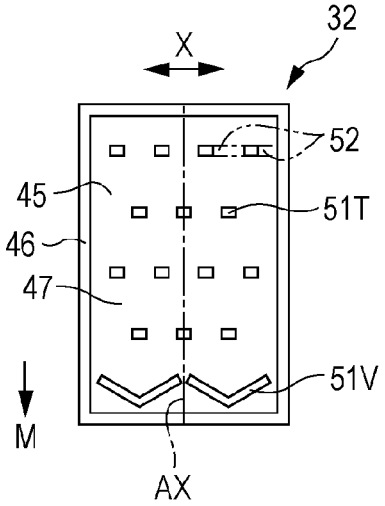
FIG. 7A is a top view that shows a first modification example of the liquid holding unit.

The liquid holding unit 32 may be configured to be provided with a plurality of kinds of protruding units 51T and 51V, the shapes of which differ, in the manner of a first modification example that is shown in FIG. 7A. For example, a length in the extension direction (the width direction) of the protruding units 51T may be shorter than the pathway units 52, or the protruding units 51V may be bent toward the movement direction M.

Figure 7B:
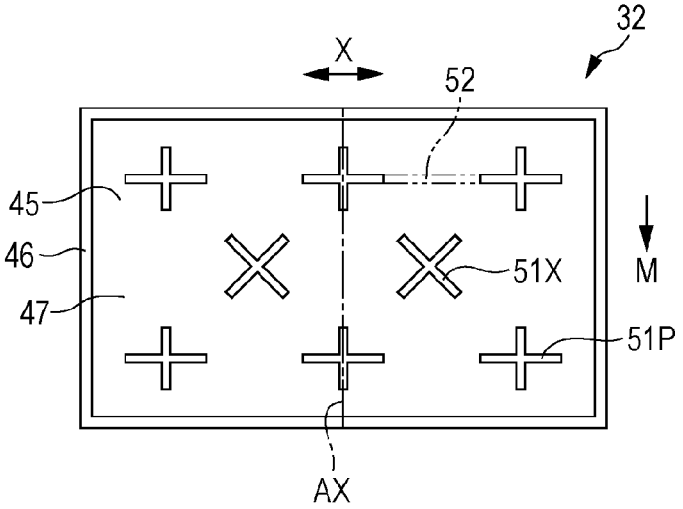
FIG. 7B is a top view that shows a second modification example of the liquid holding unit.

A short side of the liquid holding unit 32 may be the movement direction M in the manner of a second modification example that is shown in FIG. 7B.

In the manner of the second modification example that is shown in FIG. 7B, protruding units 51P that are cross-shaped in a plan view, and in which wall-shaped protruding units that extend in the width direction X and wall-shaped protruding units that extend in the movement direction M are made to intersect, may be formed, and protruding units 51X that are X-shaped in a plan view, and in which two wall-shaped protruding units that are inclined with respect to the movement direction M are made to intersect, may be formed.

Figure 8:
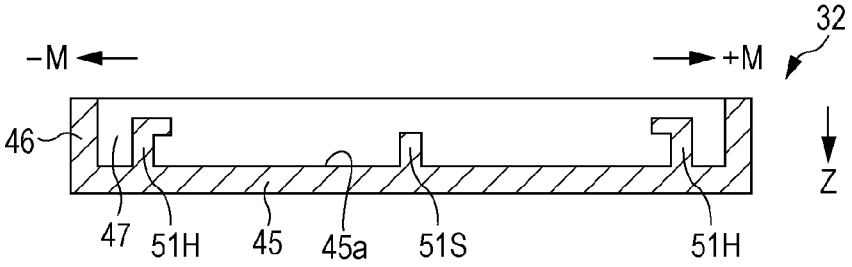
FIG. 8 is a cross-sectional view that shows a third modification example of the liquid holding unit.

Leading ends of protruding units 51H, which are positioned in the liquid accumulation unit 47 at both end sides in the movement direction M, may respectively be bent toward an inner side of the liquid accumulation unit 47 in the manner of a third modification example that is shown in FIG. 8. In addition, a protruding unit 51S may be provided between the two protruding units 51H in the movement direction M, and the protruding heights of the two protruding units 51H from the bottom unit 45 (the bottom surface 45*a*) may be greater than that of the protruding unit 51S. If this kind of configuration is used, as a result of the protruding units 51H that are positioned in front of the protruding unit 51S, it is even possible to suppress the liquid from flowing along the movement direction M in a case in which the liquid that flows due to an inertial force flows over the protruding unit 51S. In addition, if the leading ends of the protruding units 51H are bent toward the inner side of the liquid accumulation unit 47, it is possible to suppress carrying of the liquid that tends to flow over the protruding units 51H with the leading end portions of the protruding units 51H.

Figure 9A:
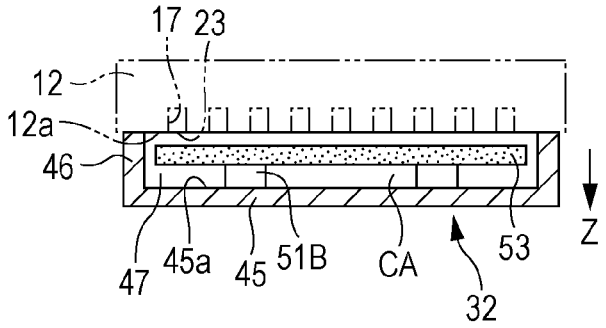
FIG. 9A is a cross-sectional view that shows a fourth modification example of the liquid holding unit.
Figure 9B:
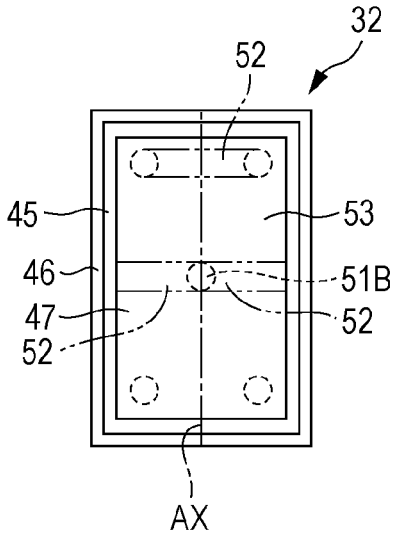
FIG. 9B is a top view of a liquid holding unit of the fourth modification example.

The liquid holding unit 32 may have a liquid receiving unit 53 that is disposed in the liquid accumulation unit 47 above a protruding unit 51B in a vertical direction in the manner of a fourth modification example that is shown in FIGS. 9A and 9B. The liquid receiving unit 53 can, for example, be configured by a plate-shaped resin member, a porous material or the like. In addition, the liquid receiving unit 53 may be set to have a configuration of being supported by the protruding unit 51B, or a liquid receiving unit 53 and protruding unit 51B which are integrally formed may set as a single protruding unit.

In this instance, if suction cleaning is performed in the liquid ejecting apparatus 11, there are instances in which the liquid that is discharged from the nozzles 17 has become liquid droplets, which are attached to the opening surface 12*a* and is left behind. At this time, it is possible to remove the liquid droplets from the opening surface 12*a* by touching the liquid droplets that are attached to the opening surface 12*a* with the liquid receiving unit 53, which is disposed so as to face the ejection apertures 23. Additionally, if the liquid receiving unit 53 is configured by a porous material, since it is possible to suction liquid droplets with which the liquid receiving unit 53 has come into contact using a capillary force of holes that are formed inside the liquid receiving unit 53, it is possible to efficiently remove liquid droplets.

In addition, liquid droplets that are ejected from the nozzles 17 when performing flushing are received by the liquid receiving unit 53 before entering the liquid accumulation unit 47. Additionally, if flushing is performed, there are cases in which fine mist is generated in addition to the liquid droplets and becomes attached to the opening surface 12*a*. If this kind of mist gradually become larger on the opening surface 12*a* and forms liquid droplets, there are cases in which the liquid droplets that have become larger come into contact with liquid droplets that are ejected from the nozzles 17, change a flight direction of the ejected liquid droplets, and therefore, cause a deterioration in printing quality. With respect to this matter, if flushing liquid droplets are received by the liquid receiving unit 53 that is disposed in mid-air inside the liquid accumulation unit 47, it is possible to shorten a flight distance of the liquid droplets that are ejected from the nozzles 17, and since it is possible to suppress the generation of mist by this amount, such a configuration is preferable.

Additionally, it is preferable to set a relationship of Vb>Va>Vw when an area of the bottom surface 45*a* of the liquid accumulation unit 47 that the bottom unit 45 forms is set as Vb, an area that the protruding units 51 project onto the bottom surface 45*a* is set as Vw, and an area that the liquid receiving unit 53 projects onto the bottom surface 45*a* is set as Va. If this kind of configuration is used, the liquid receiving unit 53, the projection area on the bottom surface 45*a* of which is greater than that of the protruding units 51, is disposed above the protruding units 51 in a vertical direction in the liquid accumulation unit 47, due to the liquid receiving unit 53, it is possible to suppress carrying of the liquid that tends to flow over the protruding units 51. In addition, since a projection area of the liquid receiving unit 53 on the bottom surface 45*a* is smaller than the area of the bottom surface 45, it is possible for the liquid that the liquid receiving unit 53 received to flow into the liquid accumulation unit 47. Additionally, penetration holes may be provided in the liquid receiving unit 53 in order to cause the liquid that the liquid receiving unit 53 received to rapidly flow downstream toward the liquid accumulation unit 47.

As shown in FIGS. 7A, 7B and 9B, the protruding units 51 (51T, 51V, 51P, 51X and 51B) and the pathway units 52 may be disposed so as to be in line symmetry in the extension direction (the width direction X) of the liquid accumulation unit 47 with a center line thereof as a target axis AX thereof. If this kind of configuration is used, since the protruding units 51 and the pathway units 52 are disposed in a regular manner in the extension direction (the width direction X), it is possible to reduce the carrying speed of the liquid and deviations in the amount of the liquid that flows inside the liquid accumulation unit 47.

Figure 10:
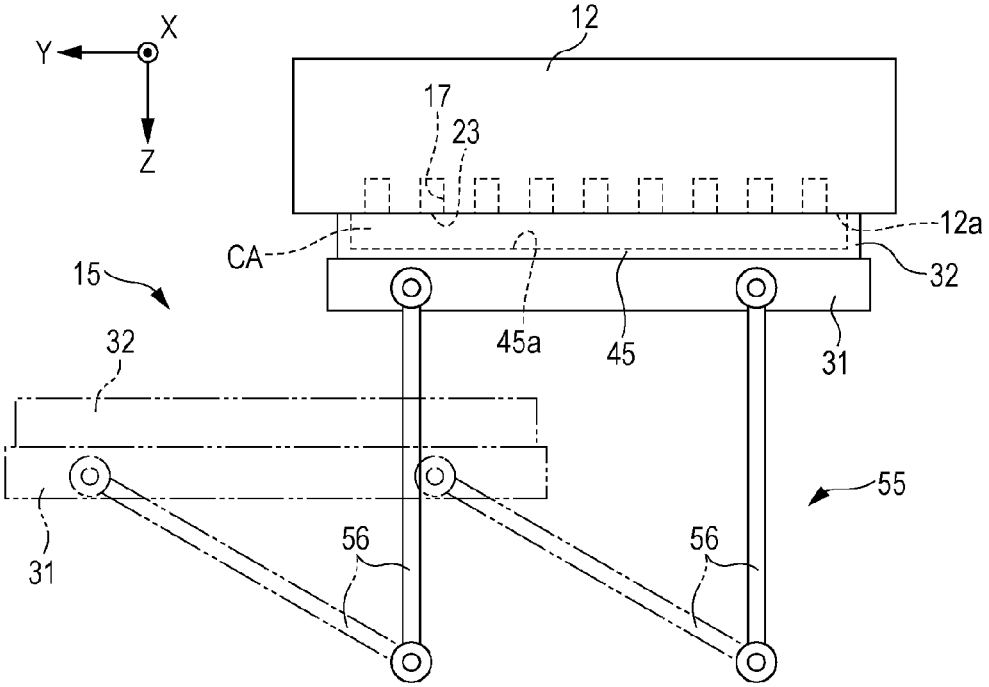
FIG. 10 is a schematic view that shows a configuration and an action of an attitude retention mechanism.

The liquid receiving device 15 may be configured so as to be provided with an attitude retention mechanism 55 that causes an attitude of the liquid holding unit 32 to be retained so that the bottom unit 45 (the bottom surface 45*a*) becomes horizontal during movement in the movement direction M and during stopping of the liquid holding unit 32 in the manner of a fifth modification example that is shown in FIG. 10. The attitude retention mechanism 55 can, for example, be configured as a link mechanism that has at least a pair of link members 56 in which in addition to one end side being rotatably connected to the supporting member 31, the other end side is rotatably connected to a support unit that is not shown in the drawings.

If this kind of configuration is used, since, due to the attitude retention mechanism 55, the attitude of the liquid holding unit 32 is retained so that the bottom unit 45 becomes horizontal, it is even difficult for the liquid to spill outside the liquid accumulation unit 47 in a case in which the liquid that is accumulated in the liquid accumulation unit 47 flows due to an inertial force during movement in the movement direction M and stopping.

Figure 11:
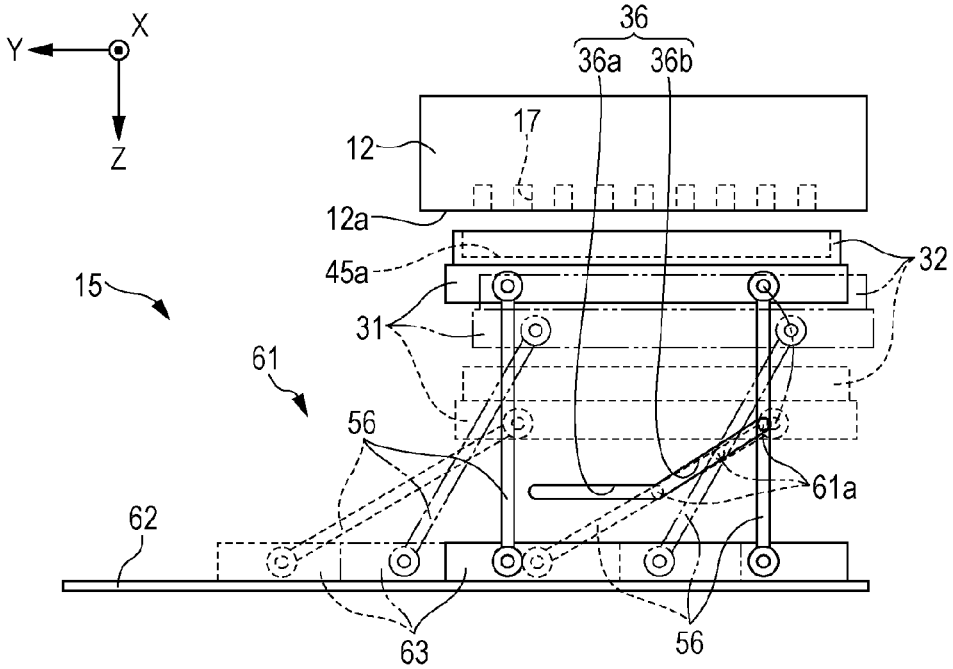
FIG. 11 is a schematic view that shows a configuration and an action of another attitude retention mechanism.

The liquid receiving device 15 may be configured so as to be provided with an attitude retention mechanism 61 that causes the attitude of the liquid holding unit 32 to be retained so that the bottom surface 45*a* becomes horizontal during movement and during stopping of the liquid holding unit 32 in the manner of a sixth modification example that is shown in FIG. 11.

The attitude retention mechanism 61 has a guide unit 62 that effectively extends in a horizontal direction, a moving body 63 that moves along the guide unit 62, and at least a pair of link members 56 in which, while one end (the bottom end) is rotatably connected to the moving body 63, the other end (the top end) is rotatably connected to the supporting member 31. A salient unit 61*a* that engages with the guide rails 36 that have the horizontal unit 36*a* and the inclined unit 36*b* is provided in a protruding manner between one end and the other end of the link member 56.

In a case in which the moving body 63 moves along the guide unit 62 in a horizontal direction, the liquid holding unit 32 effectively moves in a horizontal direction when the salient unit 61*a* is engaged with the horizontal unit 36*a*, and effectively moves in a vertical direction when the salient unit 61*a* is engaged with the inclined unit 36*b*. Additionally, when the moving body 63 moves in a horizontal direction in a state in which the salient unit 61*a* is engaged with the inclined unit 36*b*, the liquid holding unit 32 moves in a vertical direction by tracing a curved route in a manner that is shown by a chain line in FIG. 11.

In this manner, in a case in which "the liquid holding unit 32 effectively moves in a vertical direction (or a horizontal direction)", the liquid holding unit 32 includes a case of moving in the vertical direction (or the horizontal direction)" while curving, or while inclining as well as a case of moving directly in the vertical direction (or the horizontal direction)". That is, if an initial position and a terminal position of movement of the liquid holding unit 32 are separated in a horizontal direction, the liquid holding unit 32 effectively moves in a horizontal direction, and if an initial position and a terminal position of movement of the liquid holding unit 32 are separated in a vertical direction, the liquid holding unit 32 effectively moves in a vertical direction.

Further, a movement route of the liquid holding unit 32 includes a portion that effectively extends from the receiving position in a horizontal direction and a portion that effectively extends from the receiving position in the direction of gravity Z (a position that is shown by a solid line in FIG. 11). According to this configuration, since the movement route of the liquid holding unit 32 includes a portion that effectively extends from the receiving position in the direction of gravity Z, at which it is possible to receive the liquid, it is difficult for the liquid to flow in a horizontal direction when movement of the liquid holding unit 32 from the standby position is initiated and stopped at the receiving position. In addition, since the movement route immediately prior to the liquid holding unit 32 stopping at the receiving position curves in a horizontal direction in a manner that approaches the initial position of movement (the standby position) while heading toward a vertical direction, it is possible to reduce a momentum of the liquid that runs into the peripheral wall unit 46 when the liquid holding unit 32 stops at the receiving position. Therefore, it is possible to suppress scattering of the liquid that flows due to an inertial force when the liquid holding unit 32 stops moving at the receiving position. As a result of this, it is possible to suppress the attachment of liquid that has been scattered from the liquid holding unit 32, which is in the receiving position, to the media S or a transport route of the media S.

Additionally, in addition to being disposed in a capping position at which capping is performed coming into contact with the liquid ejecting unit 12 when the salient unit 61*a* is engaged with the vicinity of a top end of the inclined unit 36*b*, the liquid holding unit 32 may be disposed in the receiving position when the salient unit 61*a* is engaged with an intermediate position of the inclined unit 36*b*. In this case, while the standby position is set in the vicinity of a bottom end of the movement route of the liquid holding unit 32, the capping position is set in the vicinity of a top end of the movement route of the liquid holding unit 32. In addition, the receiving position is set between the capping position and the standby position in the movement route of the liquid holding unit 32. According to this configuration, since it is not necessary to move the liquid ejecting unit 12 when capping is performed, a movement mechanism that moves the liquid ejecting unit 12 for capping need not be provided, and therefore, it is possible to simplify the apparatus by this amount.

The movement mechanism 33 may be configured in a manner in which the horizontal unit 36*a* is not provided in the guide rail 36, and the liquid holding unit 32 is moved along a movement direction that intersects the direction of gravity Z and a horizontal direction in an oblique manner. Additionally, if the liquid holding unit 32 moves in a direction that intersects a horizontal direction, since a component that acts in a vertical direction is included in the inertial force that causes the liquid to flow, there is a concern that the liquid that collides with the protruding units 51 will flow over the protruding units 51. With respect to this matter, if the protruding units 51 are disposed in positions that are separated from the peripheral wall unit 46 in the movement direction M, due to the peripheral wall unit 46 which is in front of the protruding units 51, it is even possible to suppress the liquid from flowing in a case in which the liquid that collides with the protruding units 51 flows over the protruding units 51.

In addition, by moving the liquid holding unit 32 in this manner in a movement direction that intersects the direction of gravity Z and a horizontal direction, it may be configured so that a closed space CA is formed by the liquid holding unit 32 moving in a movement direction that intersects the opening surface 12*a* in an oblique manner and coming into contact with the opening surface 12*a* in the manner of the fifth modification example that is shown in FIG. 10.

Additionally, if the liquid holding unit 32 moves in a direction that is orthogonal to the opening surface 12*a* and comes into contact with the opening surface 12*a*, there is a concern that an impact will be applied to the liquid ejecting unit 12 during contact. In addition, if the liquid holding unit 32 moves in a direction along the opening surface 12*a* toward a position at which the closed space CA is formed, there is a concern that a meniscus of the liquid that is formed in the ejection apertures 23 will be ruptured, or that the opening surface 12*a* will be damaged by the liquid holding unit 32 sliding into the opening surface 12*a*. With respect to this matter, as a result of the liquid holding unit 32 moving in the movement direction M that intersects the opening surface 12*a* in an oblique manner, in addition to suppressing an impact that is applied to the liquid ejecting unit 12 during contact, it is possible to suppress contact with the opening surface 12*a*.

In addition, in a case in which, in addition to being brought into contact with the liquid ejecting unit 12 by moving in an outward manner, the liquid holding unit 32 is separated from the liquid ejecting unit 12 by moving in a return manner, it is preferable that a movement velocity during the outward movement, in which the liquid holding unit 32 comes into contact with the liquid ejecting unit 12, be made slower than the return movement in which the liquid holding unit 32 is separated from the liquid ejecting unit 12. If this kind of configuration is used, it is possible to reduce an impact that the liquid ejecting unit 12 is subjected to when the liquid holding unit 32 comes into contact therewith.

The inclined unit 36*b* need not be provided in the guide rail 36. That is, the movement direction of the liquid holding unit 32 may effectively be a horizontal direction. In this manner, as long as the movement direction is a direction that intersects the direction of gravity Z, the movement direction of the liquid holding unit 32 can be changed arbitrarily. For example, the liquid holding unit 32 may be configured so as to move in the width direction X. However, by setting the standby position of the liquid holding unit 32 to a lower side in a vertical direction than the receiving position, since it is possible to dispose the liquid holding unit 32 below the transport mechanism 14 in the standby position, the apparatus is achieved without an increase in size in the width direction X.

The liquid holding unit 32 may be a flushing box that receives the liquid that is ejected from the liquid ejecting unit 12. In this case, the liquid holding unit 32 need not come into contact with the liquid ejecting unit 12, and the protruding height of the protruding units 51 from the bottom unit 45 (the bottom surface 45*a*) may be greater than that of the peripheral wall unit 46. In addition, the liquid receiving device 15 need not be provided with the air opening mechanism 35.

The liquid ejecting unit 12 may be configured so as to perform printing on the media S while reciprocating in the width direction X that intersects the transport direction Y. In this case, a liquid receiving device 15 that has a liquid holding unit 32, which is a cap, may be disposed on one end side in a movement direction of the liquid ejecting unit 12, and a liquid receiving device 15, which has a liquid holding unit 32, which is a flushing box, may be disposed on the other end side in the movement direction of the liquid ejecting unit 12.

The medium S is not limited to sheets of paper, and may be a plastic film, a thin plate material or the like, or may be a fabric that is used in textile printing or the like.

The liquid that the liquid ejecting unit 12 ejects may be a liquid other than ink, and may be a liquid state body in which particles of a functional material are dispersed or mixed into a liquid. For example, the liquid ejecting unit 12 may be set to a configuration that performs recording (printing) by ejecting a liquid state body that includes a material such as an electrode material or a color material that is used in the manufacture or the like of a liquid crystal display, an EL (electroluminescence) display, or a surface-emitting display in a dispersed or dissolved form.

What is claimed is:

1. A liquid receiving device comprising:

a liquid holding unit that has a bottom portion and a peripheral wall portion that is installed in the bottom portion in a protruding manner, and in which the bottom portion and the peripheral wall portion form a liquid accumulation unit that is capable of accumulating a liquid, the liquid holding unit being capable of moving in a movement direction that intersects a direction of gravity; and an attitude retention mechanism that causes an attitude of the liquid holding unit to be retained so that the bottom portion becomes horizontal during movement in the movement direction and stopping, wherein the liquid holding unit has protruding portions that protrude further upward than the bottom portion in a vertical direction in the liquid accumulation unit, wherein the protruding portions extend lengthwise in an extension direction intersecting the movement direction and the direction of gravity, and the protruding portions that are adjacent in the movement direction are arranged to be shifted in the extension direction, wherein the liquid holding unit is capable of moving between a receiving position, at which the liquid holding unit is capable of receiving liquid, and a standby position that is set below the receiving position in a vertical direction, and a movement route of the liquid holding unit includes a portion that effectively extends from the standby position in a horizontal direction, and a portion that effectively extends from the receiving position in the direction of gravity.

2. The liquid receiving device according to claim 1, wherein, in addition to a discharge hole for discharging the liquid that is accumulated in the liquid accumulation unit being provided in the bottom portion, the peripheral wall portion is provided in the bottom portion in a protruding manner so as to surround the discharge hole, and wherein pathway units that allow the flow of liquid along the movement direction are provided in the liquid accumulation unit in positions that are lined up with the protruding portions in the extension direction.

3. The liquid receiving device according to claim 2, wherein, in addition to the pathway units being provided in the liquid accumulation unit in positions that are lined up with the protruding units in the movement direction, the protruding units are provided in positions that are lined up with the pathway units in the movement direction.

4. The liquid receiving device according to claim 3, wherein, in the liquid accumulation unit, a first row in which even-numbered protruding units and odd-numbered pathway units are mutually lined up in the extension direction, and a second row in which odd-numbered protruding units and even-numbered pathway units are mutually lined up in the extension direction, are provided so as to be mutually lined up in the movement direction.

5. The liquid receiving device according to claim 2, wherein the protruding portions and the pathway units are disposed so as to be in line symmetry in the extension direction of the liquid accumulation unit with a center line thereof as a target axis thereof.

6. The liquid receiving device according to claim 1, wherein the protruding portions are provided in the bottom portion in a protruding manner, and wherein, in protruding heights from the bottom portion, that of a peripheral wall portion is greater than that of the protruding portions.

7. The liquid receiving device according to claim 1, wherein the movement direction effectively is a horizontal direction.

8. The liquid receiving device according to claim 1, wherein the movement direction is a direction that intersects the direction of gravity and a horizontal direction, and wherein the protruding portions are disposed in positions which are separated from a peripheral wall portion in the movement direction.

9. The liquid receiving device according to claim 1, wherein the liquid holding unit is capable of moving between a receiving position, at which the liquid holding unit is capable of receiving liquid, and a standby position that is set below the receiving position in a vertical direction, and a movement route of the liquid holding unit includes a portion that effectively extends from the standby position in a horizontal direction, and a portion that effectively extends from the receiving position in the direction of gravity.

10. The liquid receiving device according to claim 1, wherein the liquid holding unit has a liquid receiving unit that is disposed in the liquid accumulation unit above the protruding units in a vertical direction, and wherein, a relationship of Vb>Va>Vw is attained when an area of a bottom surface of the liquid accumulation unit that the bottom portion forms is set as Vb, an area that the protruding portions project onto the bottom surface is set as Vw, and an area that the liquid receiving unit projects onto the bottom surface is set as Va.

11. A liquid ejecting apparatus comprising:

a liquid ejecting unit that is capable of ejecting a liquid; and the liquid receiving device according to claim 1.

12. The liquid receiving device according to claim 1, wherein the protruding portions are disposed such that a flow velocity of liquid accumulated in the liquid accumulation unit in the movement direction is reduced to thereby at least partially prevent the liquid from reaching the peripheral wall portion.

13. The liquid receiving device according to claim 1, wherein pathway units that allow the flow of liquid along the movement direction are provided in the liquid accumulation unit in positions that are lined up with the protruding portions in the extension direction, and the protruding portions and the pathway units are disposed so as to be alternately lined up in the movement direction.

14. The liquid receiving device according to claim 1, an attitude retention mechanism that causes an attitude of the liquid holding unit to be retained so that the bottom portion becomes horizontal during movement in the movement direction and stopping.

15. A liquid receiving device comprising:

a liquid holding portion that has a bottom portion and a peripheral wall portion that is installed in the bottom portion in a protruding manner, and in which the bottom portion and the peripheral wall portion form a liquid accumulation portion that is capable of accumulating a liquid, and wherein the liquid holding portion is capable of moving in a movement direction that intersects a direction of gravity, and has protruding portions that protrude further upward than the bottom portion in a vertical direction in the liquid accumulation portion, wherein the protruding portions extend lengthwise in an extension direction intersecting the movement direction and the direction of gravity, and the protruding portions that are adjacent in the movement direction are arranged to be shifted in the extension direction, wherein, in addition to a discharge hole for discharging the liquid that is accumulated in the liquid accumulation portion being provided in the bottom portion, the peripheral wall portion is provided in the bottom portion in a protruding manner so as to surround the discharge hole, and wherein pathway portions that allow the flow of liquid along the movement direction are provided in the liquid accumulation portion in positions that are lined up with the protruding portions in the extension direction, wherein, in addition to the pathway portions being provided in the liquid accumulation portion in positions that are lined up with the protruding portions in the movement direction, the protruding portions are provided in positions that are lined up with the pathway portions in the movement direction, wherein, in the liquid accumulation portion, a first row in which even-numbered protruding portions and odd-numbered pathway portions are mutually lined up in the extension direction, and a second row in which odd-numbered protruding portions and even-numbered pathway portions are mutually lined up in the extension direction, are provided so as to be mutually lined up in the movement direction.

16. A liquid receiving device comprising:

a liquid holding portion that has a bottom portion and a peripheral wall portion that is installed in the bottom portion in a protruding manner, and in which the bottom portion and the peripheral wall portion form a liquid accumulation portion that is capable of accumulating a liquid, and wherein the liquid holding portion is capable of moving in a movement direction that intersects a direction of gravity, and has protruding portions that protrude further upward than the bottom portion in a vertical direction in the liquid accumulation portion, wherein the protruding portions extend lengthwise in an extension direction intersecting the movement direction and the direction of gravity, and the protruding portions that are adjacent in the movement direction are arranged to be shifted in the extension direction, wherein, in addition to a discharge hole for discharging the liquid that is accumulated in the liquid accumulation portion being provided in the bottom portion, the peripheral wall portion is provided in the bottom portion in a protruding manner so as to surround the discharge hole, and wherein pathway portions that allow the flow of liquid along the movement direction are provided in the liquid accumulation portion in positions that are lined up with the protruding portions in the extension direction, wherein the protruding portions and the pathway portions are disposed so as to be in line symmetry in the extension direction of the liquid accumulation portion with a center line thereof as a target axis thereof.

* * * * *